United States Patent [19]

Kaiser

[11] 4,395,039

[45] Jul. 26, 1983

[54] METHOD OF EXERCISING

[75] Inventor: Robert T. Kaiser, South Jordan, Utah

[73] Assignee: Kaiser-Farmer Development Corp., Utah

[21] Appl. No.: 267,382

[22] Filed: May 26, 1981

[51] Int. Cl.[3] ..... A61H 1/02; A63B 21/02; A63B 21/32

[52] U.S. Cl. ..... 272/126; 128/25 R; 272/137; 272/142

[58] Field of Search ..... 273/1 GH; 272/126, 125, 272/135, 137, 142, 143; 434/247; 128/25 R, 26

[56] References Cited

U.S. PATENT DOCUMENTS

| | | | |
|---|---|---|---|
| 3,323,518 | 6/1967 | Swanson | 128/25 R |
| 3,323,796 | 6/1967 | Carlson | 273/1 GH |
| 3,813,098 | 5/1974 | Fischer et al. | 273/DIG. 12 X |
| 3,892,230 | 7/1975 | Baker | 128/25 R |
| 4,026,549 | 5/1977 | Gunn | 272/142 X |

*Primary Examiner*—George J. Marlo
*Attorney, Agent, or Firm*—Thorpe, North & Western

[57] ABSTRACT

A method for individual, patient-applied therapy for rehabilitation of arm and shoulder injuries. The method is self-applied by the patient, using a rigid member which has an exercise gripping member attached at one end of the rigid member by an elastic connecting means. The method is practiced by (i) grasping the elongated rigid member with the non-injured arm, (ii) grasping the exercise gripping member with the hand of the injured arm, (iii) moving the elongated rigid member with the non-injured arm to rotate the injured arm to an extreme position, (iv) reciprocating the rigid member along a desired exercise path to likewise reciprocate the injured arm of the patient, and (v) repeating this sequence to increase the extent of available movement of the injured arm.

17 Claims, 17 Drawing Figures

METHOD OF EXERCISING

BACKGROUND OF THE INVENTION

1. Field of the Invention

This invention pertains to an apparatus and method for rehabilitative exercise of a shoulder or arm injury. More specifically, the subject exercise device and method are uniquely adapted for isokinetic type exercise utilizing the patient's own body as part of the exercise system. Such isokinetic exercises include both passive and active movements.

2 Description of Prior Art

The rehabilitation of a shoulder, arm or wrist injury involves the progressive treatment of the patient through several different phases. Typically, the first phase of rehabilitation is to restore flexibility to the injured part of the body (for simplicity, general reference to the arm includes reference to the shoulder, elbow, arm or wrist). This flexibility is represented by a normal range of motion between the extremes of motion permitted for the particular part of the anatomy. For example, full flexibility of the arm would permit excursion from a lower extremity where the arm projects downward in a rearward direction through an upper extreme position.

Where injury has occurred, this range of motion or flexibility is often substantially reduced. Rehabilitation to regain flexibility is typically accomplished by passive motion wherein the injured arm is moved by an external force, such as the other arm, a physical therapist or a machine. By starting out with a restricted excursion path and gradually extending the range of motion toward each of the extreme positions, flexibility can frequently be restored.

Once the patient has the desired flexibility wherein the arm can be moved through a full range of motion without pain or further damage, the second phase of rehabilitation is initiated involving improvement of flexibility at the extremes of motion. This is a particularly dangerous part of the rehabilitation treatment because the patient is most succeptable to strains and other forms of injuries which occur when the muscles and tendons are being stretched to their limits.

None of the state of the art devices or methods of therapy are satisfactory for this second phase of rehabilitation because they lack adequate control over very slight movements which can exceed the proper range of motion and thereby cause further injury to the patient. It should be noted that very slight movement in exercises conducted at the extremities of the range of motion can cause further strain, and the mere registration of pain by the patient may be too late to prevent such injury. Furthermore, even when the patient is in control of his own exercise program, such as with the use of weights, etc., the weight may exceed the safe range and result in inadvertent injury prior to the patient's ability to recover before being subjected to excess motion by the weight being used. This uncontrolled use of weights occurs partly because of the change in tension experienced within muscles as it rotates through any given excursion path.

For example, the forces applied by a weight held in a hanging position near the waist of the patient changes substantially as the patient flexes his arm. Maximum force is applied to the shoulder when the arm is at a right angle because of the lever effect developed by the arm in that position. This variation of force applied to the shoulder can result in unexpected changes which may overpower the strength of the patient during his rehabilitation therapy.

The third phase in rehabilitation is development of strength. Typical method involve the use of free weights in which the patient starts with lighter weights and progresses to a heavier range. Again, the problem with the use of free weights is the variation in force applied to the injury as the muscle goes through its normal excursion. A preferred type of therapy would be based on isokinetic exercise in which the resistance to the muscle varies according to the demand which the muscle places on the exercise device.

During this phase of developing strength, it is apparent that the amount of weight or force subjected to the injury must gradually be increased until natural strength is returned. Obviously, this increase in weight presents a risk that excessive weight may be applied in advance of sufficient strength in the injured muscle. This is particularly true in the extremities of motion where weakness is usually greatest.

Finally, the fourth phase of rehabilitation involves development of functional activity. In the case of the arm, the activity may involve a lifting or throwing motion, or any number of natural activities which are within the customary capabilities of the patient. Currently, there is very little practical equipment available to assist the patient in functional therapy. For example, the simulation of a throwing motion is very difficult with machines. Any machinery which has been developed to simulate such functional activity tends to be very expensive, cumbersome, large in size and complicated to operate. Where the patient attempts to enter actual participation, in the functional activity (such as sports, lifting, strenuous work etc.) renewed injury is frequent because of carelessness in avoiding activity beyond his capability.

Even in the case of expensive orthopedic equipment designed to provide somewhat of an isokenetic exercise, the equipment is not ideal for the extremes of motion. Therefore, it will be apparent to those skilled in the art that the current methods of rehabilitation fall short of meeting the needs of the typical transition in therapy to restored health. Even more significant, no single therapy device or method is adequate to meet the needs of each of the respective stages of rehabilitation. For example, a physical therapist may be helpful in restoring flexibility to the injury; however, his contribution in functional therapy is greated reduced. Where the patient assumes his own exercise program, risk of excessive strain is constantly present because of inexperience or an anxiety to accelerate the rehabilitation process. Finally, none of the prior art methods or devices are well suited for therapy in the extreme ranges of motion because of their lack of sensitivity or fine tuning to the actual muscle strength or weakness in those extreme positions.

OBJECTS AND SUMMARY OF THE INVENTION

It is therefore an object of the present invention to provide a single exercise device capable of use in each stage of rehabilitation, which can be adapted in application to meet the varying needs of changes in strength, flexibility and functional use of the injured part of the body.

It is a further object of the present invention to provide an exercise device and method which permits the patient to control the range of movement, forces applied limits of exercise and strain.

It is a still further object of this invention to provide an exercise device and method which does not require attendance of a physical therapist or a third party.

It is yet another object of this invention to provide an exercise device and method which is inexpensive, simple in operation and adapted for storage in small spaces.

A still further object of the present invention is to provide an exercise device which incorporates structure capable of simulating functionl activity as part of the rehabilitative process.

A still further object of this invention is to provide an exercise device and method which permits fine control within the extreme ranges of motion, without high risk of excessive strain and injury.

These and other objects are realized in an exercise device specifically adapted for both active and passive rehabilitative therapy and which relies on working forces developed by the patient himself. The device includes an elongated, rigid member which has a grasping end and an exercise end. A first gripping means is attached at the grasping end of the rigid member and has a configuration adapted for comfortable grasp by the hand of the patient. A second gripping means, similarly configured for comfortable grasp by the patient's other hand, is attached to the exercise end of the rigid member by an elastic connecting means whose elasticity and tensile strength provide a stretchability characteristic compatible with exercise strength associated with the injured patient. This elastic connecting means acts as a cushioning or shock device which prevents abrupt application of force or strain to the injured part of the body. Instead, as the exercise approaches its extreme path of excursion, further movement of either the injured arm or the elongated rigid member results in extension or stretching of the elastic connecting means to prevent abrupt injury which may occur with a static line.

Several methods of exercise utilizing the subject device are described and illustrate the adaptability thereof to each of the various phases of rehabilitation. Because of the elastic character of the connecting means, this invention is particularly well suited for therapy in the extreme ranges of motion. These methods of exercise illustrate various passive and active forms of activity which can be applied as part of a rehabilitation process for a shoulder injury.

Other objects of the present invention, and its broader scope in connection with other injuries, will be apparent to those skilled in the art from the following detailed description of preferred embodiments, taken in combination with the figures forming part of this disclosure.

DETAILED DESCRIPTION OF THE DRAWINGS

Figure 1:
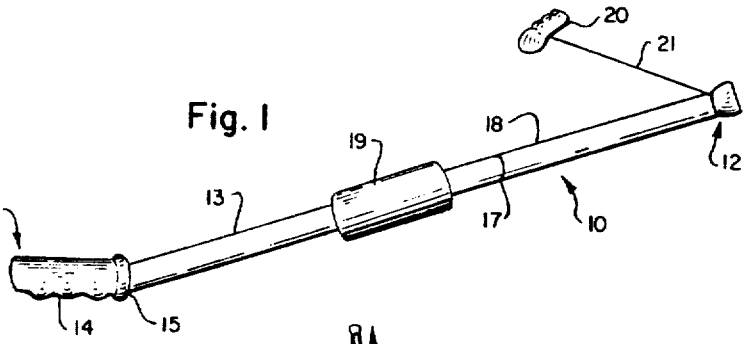
FIG. 1 is a perspective view of the subject exercise device.

FIG. 8 discloses an exercise method for strengthening the external rotators of the shoulder.

FIG. 9 illustrates a method of exercise utilizing the subject device for strengthening the extensors of the wrist and improving external rotation of the arm.

DETAILED DESCRIPTION OF THE INVENTION

Referring now to the drawings:

A preferred embodiment of the exercise device forming the subject matter of the present invention is illustrated in FIG. 1. The device includes an elongated, rigid member 10 which has a grasping end 11 and an exercising end 12. This elongated rigid member 10 may be of various types of construction, utilizing wood, plastic or metal materials in different configurations such as tubes, slats or other geometric structures which are compatible with the rehabilitative procedures outlined herein.

The specific embodiment disclosed in FIG. 1 is a tubular member composed of two separate parts. The first part is a base section 13 whose base end is the grasping end 11 previously referenced. This grasping end includes first gripping means 14 which forms a handle for the patient's use.

It will be noted that the grasping end 11 is slightly cocked or angled with an elbow 15 to facilitate a more comfortable grasp of the device during use.

The base section terminates at its other end 17 with an opening which permits telescopic insertion for an extendable section 18 which provides the means to develop slideable adjustment of the total length for the elongated rigid member. In other words, the extendable section 18 telescopically slides within the tubular base section and can be adjusted to appropriate lengths to conform to the size of the patient.

The elongated rigid member 10 is fitted with a padding section 19 which is capable of being moved along the length of the rigid member to any position where the exercise method requires placement of the tubular member against the patient's body. For example, numerous exercises utilize this rigid member to resist opposing forces in which the patient's body operates as a fulcrum to stabilize the elongated member in a certain position. The padded section 19 is helpful to relieve discomfort which may arise from direct contact of the tubular member against the patient's body.

The adaptability of the present device to both active and passive rehabilitive therapy, as well as the synergistic and unusual combination of benefits which can be developed with this device in an exercise program arise primarily in the combination of the previously explained elongated rigid member and its first gripping means 11, with a second gripping means 20 which is coupled to the exercise end 12 of the elongated gripping member by means of an elastic connecting means 21 which serves as a shock cord or cushioning device to protect the injured arm and shoulder from sudden strain or over-exertion.

The second gripping means 20 will typically be grasped by the hand of the patient's injured arm or shoulder. It should therefore be configured to provide for a comfortable grip. The elastic connecting means 21 may be of any material which provides an elastic response to forces arising between the elongated member and the second gripping means 20. Such resilient materials include elastic cords, rubber bands, springs and similar items. The degree of elasticity, as well as the tensile strength of the material, should fall within a ranges which is compatible with exercise strengths encountered with an injured patient.

Obviously, the material should begin to stretch at the occurrence of only limited resistance to provide a cushion response against sudden movements or shocks which could exceed the strength of the injured part of the body. At the same time, the material must be capable of withstanding stronger forces applied during the latter phases of rehabilitation without material failure. It will be apparent to those skilled in the art that this range of elasticity and tensile strength will vary depending upon the age and size of the patient, as well as the nature of injury and rehabilitation program required.

Substantial versatility can be developed with the subject exercise device by providing a set of different elastic connecting means 21 which have a varying range of elasticity and which can be removably fastened at the exercise end 12 of the rigid member 10. Since younger patients will not only require greater elasticity in the elastic connecting means 21, but will also require smaller gripping means 20, it may be desirable to have a series of alternate connecting means with attached gripping means 20 whose handle size is reduced to permit comfortable grasp by a child.

It will be apparent to those skilled in the art that numerous variations of structure may be utilized to implement the inventive principles which are applied by the preferred embodiment illustrated. It is therefore to be expressly understood that the tubular configuration and other mechanical features are not to be construed in any way to limit the claims, except as expressly set forth hereafter.

The scope of this invention, including the principles of use of the subject exercise device, can be better understood by reference to a representative selection of rehabilitation exercises which are uniquely adapted for use with the subject exercise device.

Figure 2B:
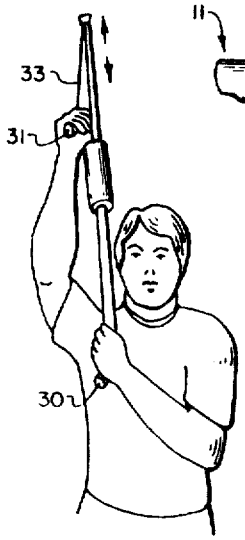
FIG. 2 illustrates a method of exercise utilizing the subject device for developing forward flexation of the arm.

FIG. 2 illustrates a method of exercise specifically adapted for rehabilitation of a patient's injured shoulder or arm by developing passive, forward flexation of the arm as part of a phase one therapy to improve flexibility. The exercise is conducted by grasping the elongated rigid member with the noninjured arm 28 as shown in FIG. 2B at its base end 30 and grasping the second gripping means 31 (referred to hereafter as "exercise gripping means") with the hand of the injured arm or shoulder 29 while maintaining the injured arm in a relaxed condition. This is the starting position for the exercise.

The patient beings the exercise by moving the free end of the elongated rigid member upward by raising the noninjured arm which is grasping the base end of the device. This upward movement continues to the extreme point where the patient is able to move within a range without encountering strain or adverse pain.

Figure 2A:
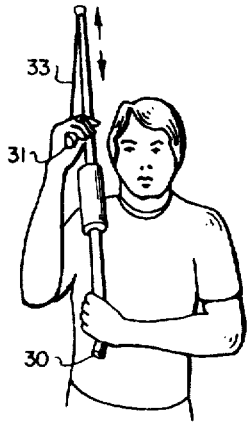

After repeating this up and down motion 39 to gently flex the injured arm, the patient then moves the free end of the rigid member to the upper extreme position as illustrated in FIG. 2A. In this extreme position, the patient then reciprocates the exercise device in a piston-like manner to apply gentle tension in that extreme range of motion and thereby increase the flexibility and range of motion for the patient. During this reciprocating motion, the elastic connecting means 33 or shock cord operates to cushion such movement against sudden and abrupt change. Since the patient is in complete control of the device and the range of movement, the patient is capable of responding to pain sensation which may help prevent excessive strain and injury.

The passive exercise illustrated in FIG. 2 can be converted to an active exercise where resistance is applied by the injured arm 29 to the reciprocating movement 39 being caused by the non-injured arm 28. This is accomplished by merely pulling down on the exercise gripping means during the course of the exercise. Again, the patient is in total control of the extent of resistance applied and can therefore avoid injury due to excessive strain.

Figure 3B:
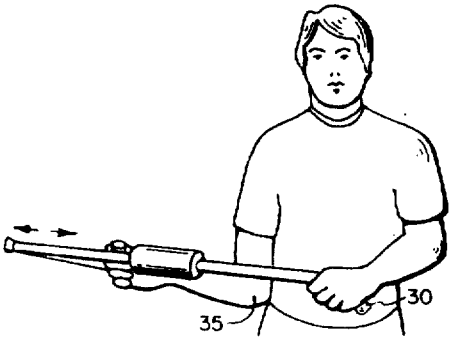
FIG. 3 illustrates another exercise designed to improve external rotation in the shoulder.
Figure 3A:
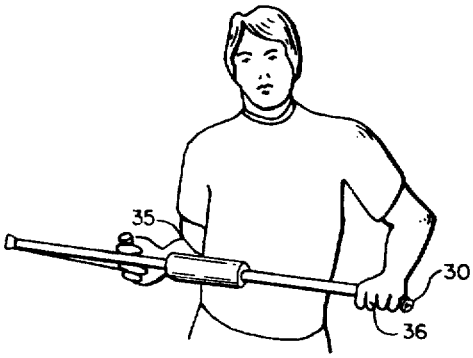

FIG. 3 illustrates a rehabilitative exercise designed to enhance flexibility in the external rotation of the injured arm 29. The starting position of this exercise involves positioning the elongated rigid member forward of the body in substantial horizontal orientation. The hand of the non-injured arm has firm grasp at the base of the device 30 and the free end of the rigid member projects toward the injured arm. The patient retains the elbow 35 of his injured arm against the body and grasps the exercise gripping member in his hand 36 (of the non-injured arm 28) as indicated in FIG. 3A. The exercise is conducted by gently pushing the elongated rigid member laterally to cause external rotation of the patient's humerus. The range of motion can be extended by repeating this exercise in reciprocating manner to gently extend the ability of the patient to reach full excursion. Again, the device is particularly useful in the extremity positions such as is illustrated in FIG. 3B. In this position, the patient can gently piston or bounce 40 the elongated rigid member to concentrate movement within this weaker range. Since the patient is not being subjected to weights which limit his control and increase risk of excess strain, his ability to exercise using the present device in these extremities is greatly enhanced.

As with the previous exercise, active resistance can be applied by the injured arm 29 to thereby strengthen internal rotators of an injured shoulder 27. This ability to combine active and passive exercises greatly broadens the scope of utility for the subject exercise device.

Figure 4B:
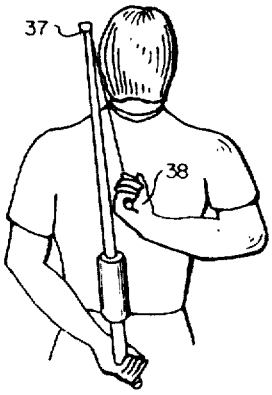
FIG. 4 illustrates another rehabilitative exercise for passively strengthening the internal rotators of the shoulder.
Figure 4A:
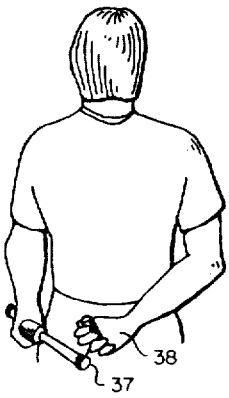

FIG. 4 illustrates another exercise for strengthening the internal rotators of the injured shoulder 41 by positioning the free end 37 of the elongated rigid member behind the patient with the hand 38 of the injured arm or shoulder 41 holding the exercise gripping means in a relaxed posture. The free end of the rigid member is then raised upward along the back causing the injured hand 38 and arm to be lifted upward 4B along the same path. This exercise is repeated in reciprocating manner to gradually extend the range of movement for the internal rotators of the shoulder. As with previous exercise patterns, a light bouncing motion can be developed at the extreme ranges of movement to further enhance flexibility in these regions. By applying active resistance at the injured hand, the same exercise can be used to strengthen the external rotators of the shoulder, when the patient pulls down on the exercise grip means while resisting movement of the elongated rigid member by the non-injured arm.

Figure 5A:
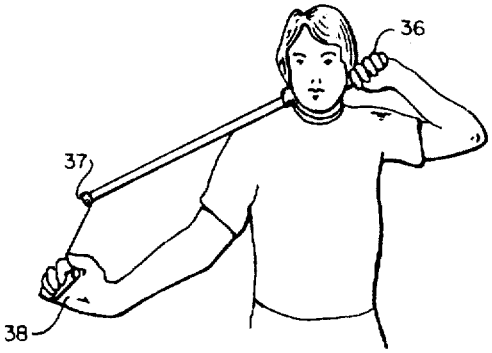
FIG. 5 illustrates an exercise method for stretching the lower pectoralis muscle group and improving external rotation of the humerus.

FIG. 5 demonstrates an exercise method useful for stretching the lower pectoralis muscle group and improving external rotation of the humerus. The method involves placement of the elongated rigid member behind the patient's neck while grasping the rigid member with the hand 36 of the non-injured arm. The free end 37 of the rigid member projects laterally past the injured shoulder of the patient and permits the hand of the injured arm to grasp the exercise gripping means. FIG. 5A represents this starting position of the exercise.

Figure 5B:
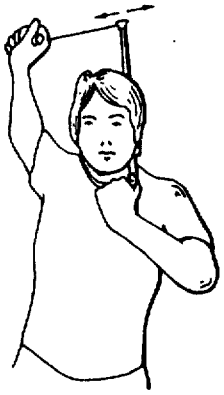

The patient then rotates the free end of the rigid member and attached exercise gripping means rearward to externally rotate the humerus and stretch the lower pectoralis muscle group. The finished position is illustrated in FIG. 5B. At this point, the patient may gently bounce 42 the injured arm, allowing the shock cord to assume part of the force. Here again, this motion at the extremes improves the flexibility and extends the range of the patient's motion. The exercise is converted to an active therapy by pulling against the free end of the rigid member with the injured arm while at the same time gently resisting rotation of the rigid member with the non-injured arm.

A significant advantage of utilizing the subject device and these methods of exercise becomes clear upon noting that the patient is in full control of the amount of tension being applied in his respective non-injured and injured arms. Therefore, the patient is able to apply the exact amount of tension during passive motion to increase flexibility of the arm without causing strain. When the patient is prepared to assume an active exercise, the patient merely pulls on the exercise gripping means and releases tension on the elongated rigid member at a rate suitable to develop the motion he desires.

Figure 6B:
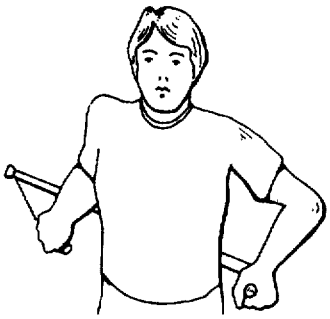
FIG. 6 illustrates the subject device as part of an exercise method for stretching the anterior deltoid muscles, bicepts tendon and upper pectoralis muscle group.
Figure 6A:
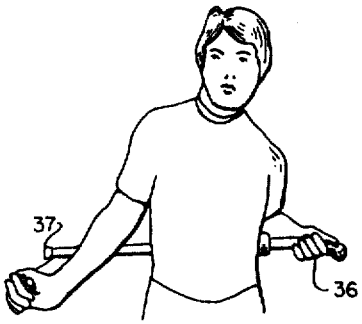

FIG. 6 illustrates another type of rehabilitative exercise utilizing the subject exercise device. In this case, the elongate rigid member is positioned behind the patient and held by the hand 36 of the non-injured arm, with the free end of the rigid member projecting laterally along the side of the patient toward the injured arm. The patient grasps the exercise gripping member with the hand 38 of the injured arm in a forward relaxed position. The exercise begins by rotating the free end 37 of the rigid member rearward using the patient's waist as a fulcrum for force being applied by the non-injured arm. This rearward rotation is continued until the extremity position is reached as illustrated in FIG. 6B. This exercise assists in stretching the anterior deltoid muscles, bicepts tendon and upper pectoralis muscle group. To increase the range of motion, the exercise device can be extended to the extremity position and slightly bounced to improve flexibility of the muscle. Here again, an active exercise can be developed by pulling on the exercise gripping member with the injured arm while applying appropriate resistance by the non-injured arm to the base of the elongated rigid member.

Figure 7B:
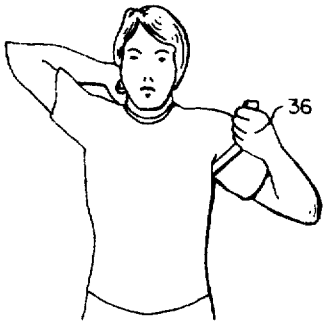
FIG. 7 illustrates an additional exercise method for improving external rotation of the shoulder.
Figure 7A:
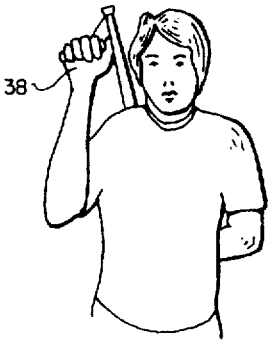

FIG. 7 illustrates a representative example of exercises particularly adapted for the subject exercise device. The elongate rigid member is positioned in upright orientation behind the patient's back with the hand of the injured arm 29 grasping the exercise gripping member in raised orientation FIG. 7A. The elongated rigid member may be rested on the back of the patient with the hand 36 of the non-injured arm 28 having a firm grasp at the base of the elongated rigid member. The exercise is conducted by the non-injured hand pulling forward on the elongated rigid member which thereby applies tension to the shock cord and gradually drags the injured arm to the rearward position illustrated in FIG. 7B. Improved flexibility in the extremity position can be realized by slightly bouncing the elongated rigid member while at this rearward position.

Figure 8B:
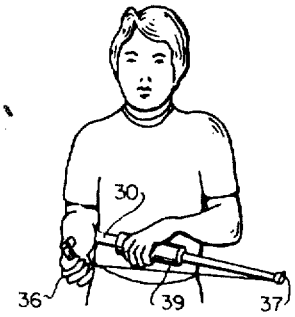
Figure 8A:
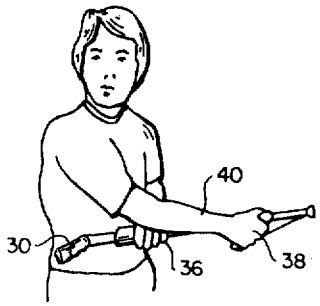

FIG. 8 illustrates an additional method of exercise wherein the base of the elongated member 30 is positioned against the side of the patient's body as illustrated in FIG. 8A. The exercise or free end of the elongated member is oriented away from the injured arm with the hand 38 of the injured arm 29 grasping the exercise gripping member such that the injured arm 29 extends accross the front of the patient's body as illustrated in FIG. 8A. The hand 36 of the non-injured arm grasps the central portion of the elongated member at the protective pad and is used to apply counter force during the course of the exercise.

This exercise is conducted by positioning the hand 38 of the injured arm with the palm of the hand toward the rigid member and by rotating the arm 29 40 away from the rigid member while at the same time applying resistance to such movement by the non-injured arm 28. Such resistance can be varied by the patient to permit the injured arm to rotate externally to the opposing side of the patient's body as illustrated in FIG. 8B. Again, bouncing motion can be developed at the extremes of movement to further extend the patient's range of motion. This exercise not only provides improved movement within the shoulder and arm, but further provides additional strength to the extensors of the wrist.

Figure 9B:
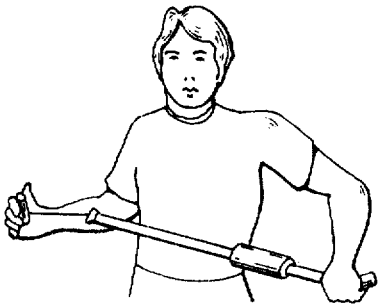
Figure 9A:
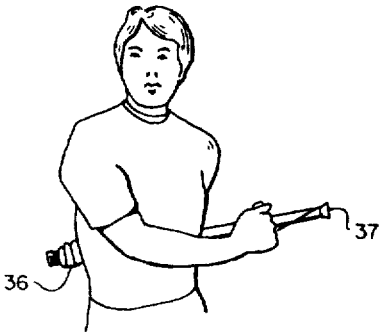

FIG. 9 illustrates a further exercise which strengthens the arm and wrist extenders and provides for developing strength in the external rotators of the shoulder. In this exercise the elongated rigid member is positioned along the side of the patient with the free or exercise end 37 projecting forward as illustrated in FIG. 9A. The hand of the injured arm 29 grasps the exercise gripping means across the front of the patient's body with the palm of the hand oriented toward the exercise device. This exercise is conducted by pulling with the injured arm across the front of the body at the exercise gripping means while applying tension with the non-injured arm 28 and hand 36 at the opposite end of the elongated rigid member. This tension is gradually released to permit the rotation of the injured arm across the front of the body to a full external rotation of the humerus as shown in FIG. 9B. During this exercise period the humerus should be retained against the side of the patient to obtain best results.

It will be apparent that numerous exercises can be developed which utilize the advantages of independent use which are provided with the subject exercise device.

As the patient progresses through the referenced four stages of rehabilitation, the subject exercise device is uniquely adapted to provide a safe and independent exercise program. During the flexibility phase, the patient is in complete control and is capable of preventing extreme movement which would tend to aggravate the injury. This is particularly true in the second phase of improving flexibility at the extremes of motion. As previously indicated, a gentle bouncing or piston-like action can be used in this phase, and is facilitated by the shock cord which tends to absorb sudden movements which might jerk the injury and create further problems.

During the strengthening phase of rehabilitation, the patient is able to apply the strength of his good arm to develop improved strength in the injury. This can be done through a series of exercises in which the patient can move from weak resistance to a more rigorous exercise program. Finally, the subject exercise device is most effective in the fourth phase of rehabilitation involving development of functional activity. This device operates without any additional machinery or expensive functional simulating apparatus. By using appropriate orientations of the exercise device, the patient can simulate virtually every shoulder movement required for functional use. Such simulated activity includes throwing or swinging motion which may be used in various sports, or it may simulate lifting or pushing motion for work or other similar activities. All of these exercises can be regulated by the patient himself, without being encumbered by machinery or fixed location.

In fact, the subject device provides a synergistic aspect in that it permits the patient total freedom of movement in that the elongated rigid member actually becomes part of his body and operates as a stress transfer means to impose resistance on the injured part during the very course of functional activity such as simulated throwing of a ball, service with a tennis racket, etc. The patient experiences the motion of the activity, as well as the exercise stress in his anatomy.

Because of the combined benefits of freedom of movement, full range of motion and simulation of functional activity, the patient attitude toward therapy is much improved, further accelerating a return to health and normal activity.

I claim:

1. A method of exercise specifically adapted for independent, individual use by a patient for rehabilitation of the patient's injured shoulder or arm using the patient's non-injured arm as an actuating force, the method comprising the steps of:

a. grasping with the non-injured arm of the patient, an elongated rigid member, said rigid member having a free end with an attached exercise gripping means coupled thereto by an elastic connecting means;
b. grasping the exercise gripping means with the hand of the injured arm or shoulder of the same patient while maintaining the injured arm in a relaxed condition;
c. moving the free end of the elongated rigid member with a non-injured arm to rotate the injured arm and shoulder to a comfortable extreme position in preparation for exercise;
d. reciprocating the free end of the rigid member in a desired exercise path to apply gentle tension through the elastic connecting means to reciprocate the patient's injured arm or shoulder; and
e. repeating steps c and d of the foregoing sequence while gradually increasing the extent of injured arm movement to greater extremities.

2. A method of exercise as defined in claim 1, wherein the elongated rigid member is positioned in front of the patient in substantial upright orientation, the injured arm being raised upward by the method of step c in claim 1, and the rigid member being reciprocated in an up-and-down piston-like motion.

3. A method as defined in claim 1, further comprising the step of applying resistance to movement with the injured arm, said resistance being and accompanying strain in the injured arm being cushioned by an elongation response of the elastic connecting means.

4. A method as defined in claim 1, wherein the exercise is directed toward external rotation of the injured arm, said elongated rigid member being positioned forward of the body in substantial horizontal orientation, the injured arm being positioned with its elbow against the body of the patient and the free end of the rigid member being reciprocated laterally to cause gentle external rotation of the patient's humerus, and repeating this exercise until full external rotation of the humerus is obtained.

5. An exercise method as described in claim 4 comprising the additional step of strengthening internal rotaters of the shoulder by applying force in the injured arm toward internal rotation from a starting position in the approximate full external rotation of the humerus, resistance to said force being applied by the non-injured arm through the elastic connecting means.

6. An exercise method as defined in claim 1 wherein the internal rotaters of the injured shoulder are passively strengthened by positioning the free end of the elongated rigid member behind the patient with the hand of the injured arm or shoulder holding the exercise gripping means in a relaxed posture, then raising the free end of the rigid member upward to lift the hand of the injured arm upward along the back of the patient, the rigid member then being reciprocated along this same path to gradually extend the range of movement for the internal rotaters of the shoulder.

7. A method as defined in claim 6, further comprising the step of strengthening the external rotaters of the shoulder by pulling down on the exercise gripping means with the injured arm, while resisting movement by counter pressure of the non-injured arm against the elongated rigid member.

8. An exercise method as defined in claim 1 for stretching the lower pectorallis muscle group and improving external rotation of the humerus, the method including placing the elongated rigid member behind the patients neck while grasping the rigid member with the hand of the non-injured arm, the free end of the rigid member projecting laterally past the injured shoulder of the patient, the hand of the injured arm grasping the exercise gripping means and the free end of the rigid member then being rotated rearward to externally rotate the humerus and stretch the lower pectoralis muscle group.

9. An exercise method as defined in claim 8, further comprising the steps of pulling against the free end of the rigid member with the injured arm while gently resisting rotation of the rigid member with the non-injured arm.

10. An exercise method as defined in claim 1, wherein the elongated rigid member is positioned behind the patient and held by the hand of the non-injured arm with the free end of the rigid member projecting laterally along the side of the patient with the injured arm, the hand of the injured arm grasping the exercise gripping means in a forward relaxed position, the reciprocating step being effected by rotating the free end of the rigid member rearward using the patient's body as a fulcrum for force being applied by the non-injured arm, and repeating these steps to stretch the anterior deltoid muscles, biceps tendon and upper pectoralis muscle group.

11. A method as defined in claim 10 for strengthening the internal rotater of the shoulder and anterior deltoid by placing resistance against the rotational movement of the free end of the rigid member in its rearward path by pushing on the exercise gripping member with the injured arm.

12. An exercise method as defined in claim 1 wherein the elongated rigid member is positioned in upright orientation behind the patient's back, the hand of the injured arm grasping the exercise gripping member in raised orientation, the elongated rigid member resting against the back of the patient, the exercise including the step of rotating the free end of the rigid member rearward by pulling forward with the uninjured arm at the opposing end of the elongated rigid member, thereby drawing the injured arm to a rearward location behind the shoulder and the head of the patient.

13. An exercise method as defined in claim 12, further comprising the step of applying force with the injured arm to bring the free end of the rigid member foward, the patient applying resistance with the non-injured arm to gently increase the strain applied toward the injured muscles.

14. An exercise method as defined in claim 1, further comprising the step of positioning a part of the elongated rigid member against the patient's body in opposing relative orientation to a projected direction of exercise such that the body serves as a fulcrum for pivotal movement of the rigid member.

15. An exercise method as defined in claim 1 for strengthening the external rotaters of the shoulder, the elongated rigid member being positioned along the side of the patient with the free end thereof projecting forward, the hand of the injured arm grasping the exercise gripping means across the front of the patient's body, the exercise being conducted by pulling with the injured arm across the front of the body at the exercise gripping means while applying tension with the non-injured arm at the opposing end of the elongated rigid member, said tension being gradually released to permit rotation of the injured arm across the front of the body to a full external rotation of the humerus, the humerus being retained against the side of the patient during the full exercise.

16. An exercise method as defined in claim 15, further comprising the step of applying a rearward force by the non-injured arm to rotate the free end of the elongated rigid member away from the injured arm while retaining grasp of the exercise gripping means, tension being applied in the injured arm in resistance to the opposing force.

17. An exercise method as defined in claim 1 for strengthening the extensors of the wrist the elongated rigid member being positioned across the front of the patient at approximate abdomen level, the free end of the elongated member projecting away from the injured arm with the hand of the injured arm grasping the exercise gripping member such that the injured arm extends across the front of the patient's body, the opposing end of the elongated rigid member being positioned against the patient's body, the hand of the non-injured arm grasping a central portion of the elongated member to provide for application of counter forces by the respective injured and non-injured arms, said exercise being conducted by positioning the hand of the injured arm with the palm of the hand toward the rigid member and by rotating the arm away from the rigid member while at the same time applying resistance force by the non-injured arm, said resistance being varied to permit the injured arm to rotate externally to the opposing side of the patient's body.

* * * * *